US005198830A

United States Patent [19]

Lin

[11] Patent Number: 5,198,830

[45] Date of Patent: Mar. 30, 1993

[54] DISH ANTENNA

[76] Inventor: Ming T. Lin, No. 3-1, Tapi Lane, Neiao Li, Nantou City, Nantou Hsien, Taiwan

[21] Appl. No.: 787,895

[22] Filed: Nov. 5, 1991

[51] Int. Cl.[5] ..... H01Q 1/12; H01Q 3/04

[52] U.S. Cl. ..... 343/882; 343/840; 248/183

[58] Field of Search ..... 343/840, 765, 878, 880, 343/881, 882, 915; 248/183, 185

[56] References Cited

U.S. PATENT DOCUMENTS

| | | | |
|---|---|---|---|
| 4,626,864 | 12/1986 | Mickelthwaite | 343/766 |
| 4,652,890 | 3/1987 | Crean | 343/882 |
| 4,800,394 | 1/1989 | Homann et al. | 343/882 |
| 4,804,971 | 2/1989 | Bruns et al. | 343/840 |
| 4,931,809 | 6/1990 | Putman et al. | 343/882 |
| 4,980,697 | 12/1990 | Eklund | 343/882 |

FOREIGN PATENT DOCUMENTS

| | | | |
|---|---|---|---|
| 0015306 | 1/1984 | Japan | 343/882 |
| 0103405 | 6/1984 | Japan | 343/878 |
| 0090403 | 5/1985 | Japan | 343/882 |

*Primary Examiner*—Michael C. Wimer
*Assistant Examiner*—Tan Ho
*Attorney, Agent, or Firm*—Fitch, Even, Tabin & Flannery

[57] ABSTRACT

A dish antenna including a dish, a base fixed to the outer surface of the dish and including a pair of lugs each including a curved slot, a coupler including a pair of flanges pivotally coupled to the lugs of the base at a pivot axle which is located at the center of curvature of the curved slots, a bolt slidably engaged in each of the curved slots and engaged on the flange for fixing the lugs to the flanges so that the angular position of the base relative to the coupler can be adjusted.

1 Claim, 4 Drawing Sheets

DISH ANTENNA

BACKGROUND OF THE INVENTION

1. Field of the Invention

The present invention relates to an antenna, and more particularly to a dish antenna.

2. Description of the Prior Art

Generally, the dish antenna comprises a dish fixed on a rod and directed toward a fixed direction so as to receive signals, from, such as from a satellite. The direction of the dish can not be adjusted.

The present invention has arisen to mitigate and/or obviate the afore-described disadvantages of the conventional dish antenna.

SUMMARY OF THE INVENTION

The primary objective of the present invention is to provide a dish antenna in which the direction of the dish can be adjusted.

In accordance with one aspect of the invention, there is provided a dish antenna comprising a dish including an outer surface, a base fixed to the outer surface of the dish and including a pair of lugs extended downward therefrom, each of the lugs including a curved slot formed therein, a coupler including a pair of flanges extended upward therefrom and pivotally coupled to the lugs of the base at a first pivot axle, the first pivot axle being located at a center of curvature of the curved slots, a bolt slidably engaged in each of the curved slots and engaged on the flange for fixing the lugs to the flanges so that an angular position of the base relative to the coupler can be adjusted.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
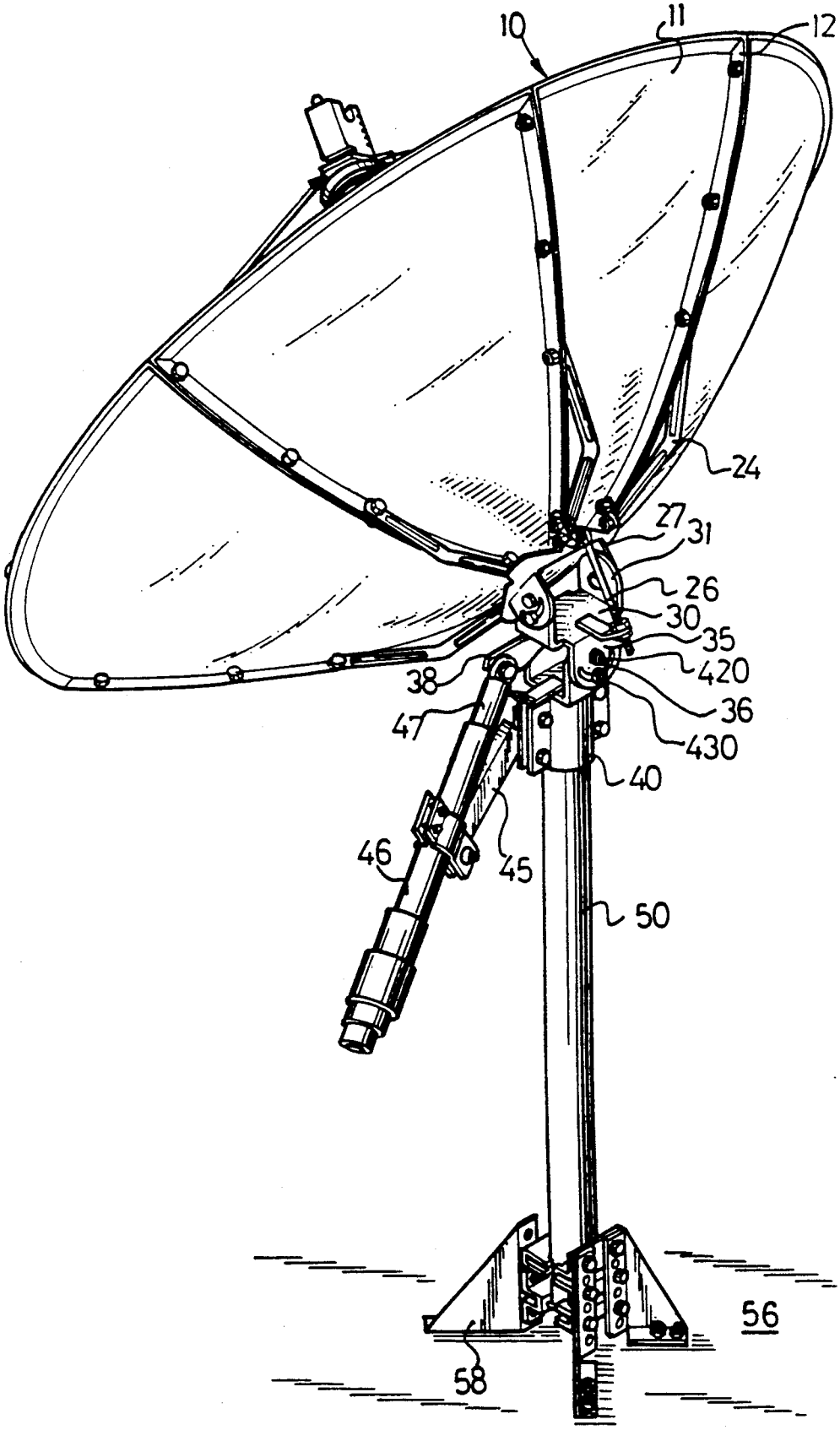
FIG. 1 is a perspective view of a dish antenna in accordance with the present invention.
Figure 2:
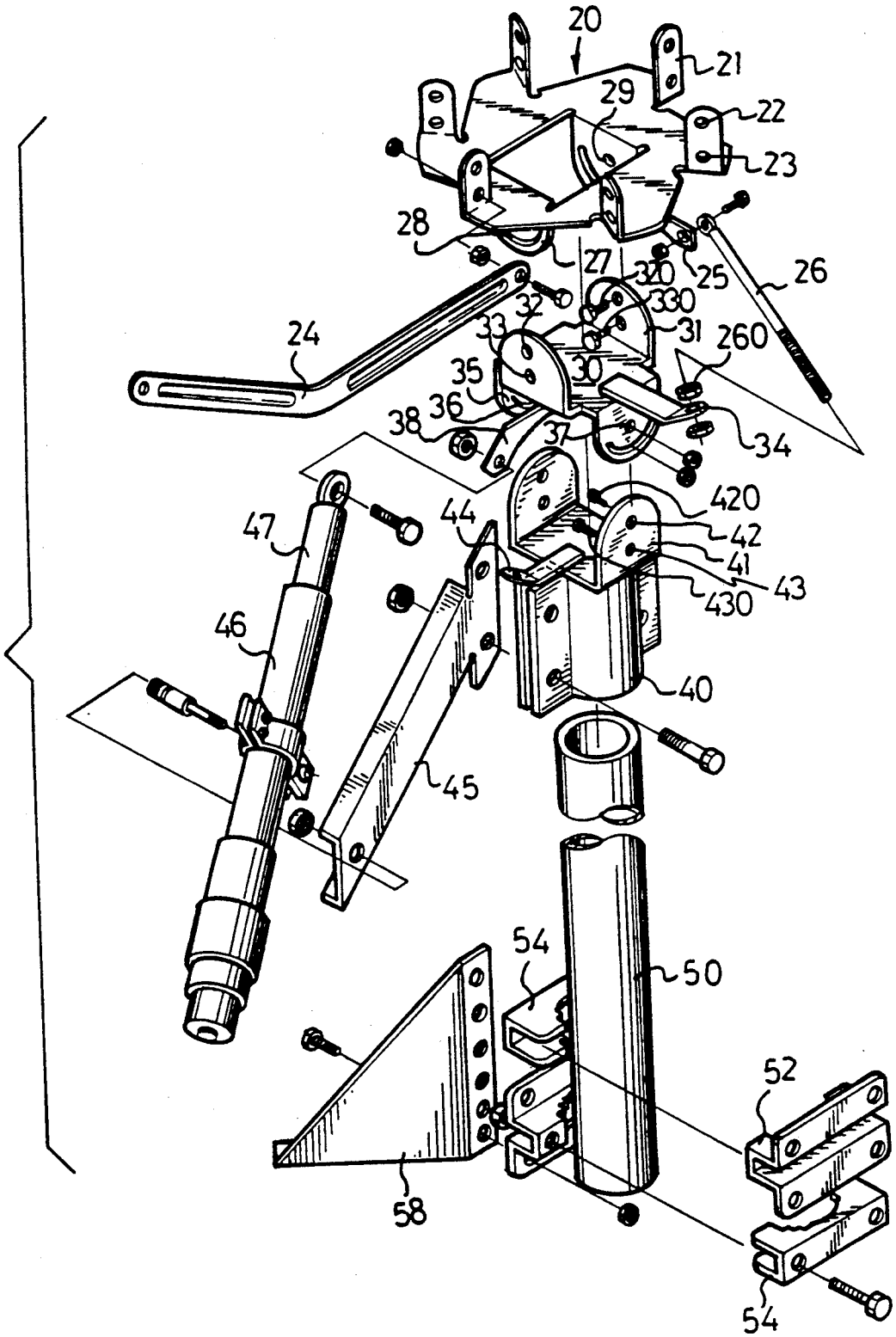
FIG. 2 is a partial exploded view of a portion of the dish antenna.
Figure 3:
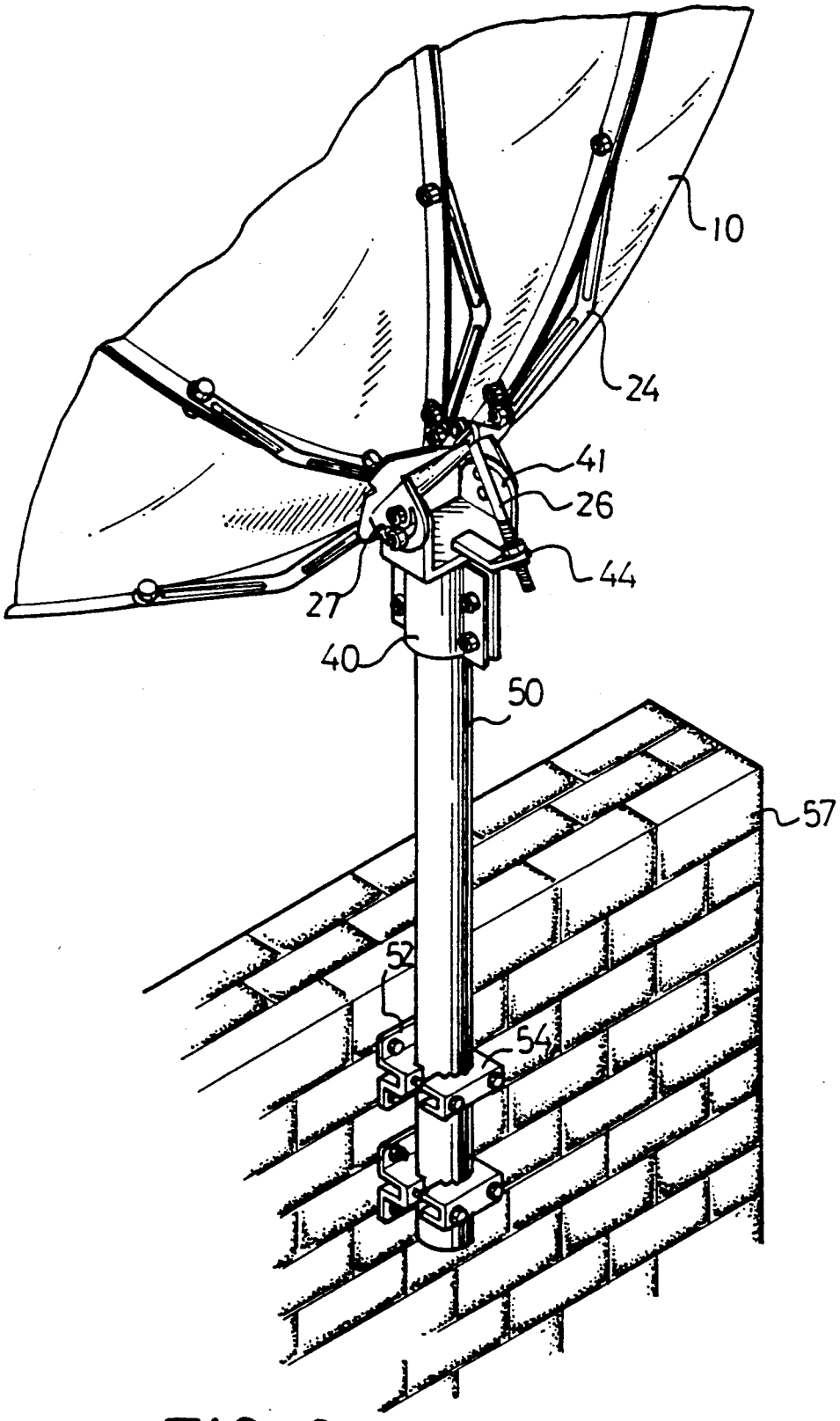
FIG. 3 is a perspective view illustrating another utilization of the present invention.
Figure 4:
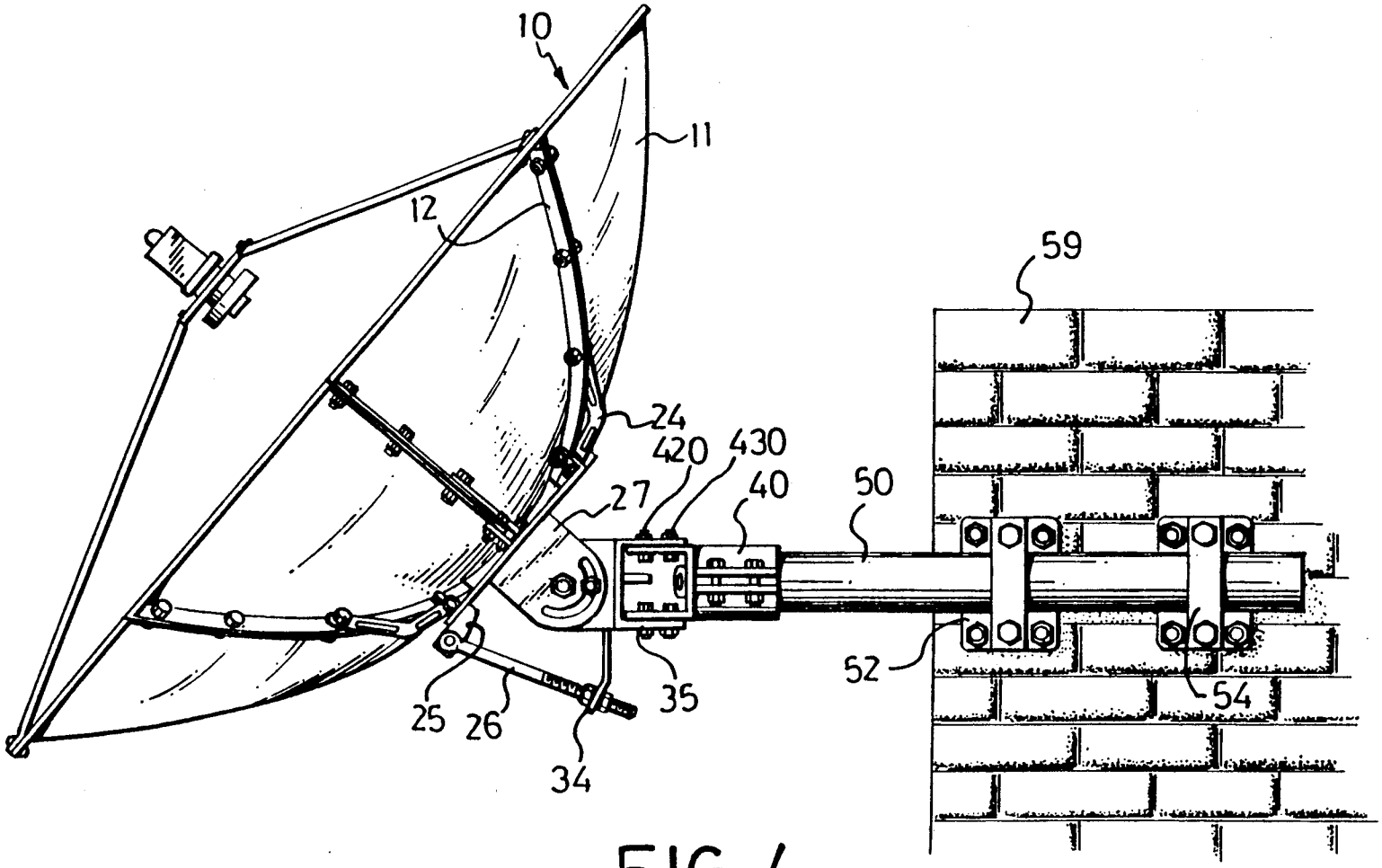
FIG. 4 is a perspective view illustrating still another utilization of the present invention.

Referring to the drawings and initially to FIGS. 1 and 2, a dish antenna in accordance with the present invention comprises generally a dish 10 including a plurality of sectors 11 coupled together by a plurality of spaced ribs 12 which are formed on the convex outer surface of the dish 10, a base 20, a guide 30 and a coupler 40 coupling the dish 10 to a post 50. The post 50 can be fixed to a supporting surface, such as the ground 56 (FIG. 1) or a wall member 57, 59 (FIGS. 3 and 4).

The base 20 includes a plurality of spaced ears 21 extended upward therefrom, in which, in this embodiment, six ears 21 are shown in the drawings. Each of the ears 21 includes a hole 22 for coupling to the bottom portion of a respective rib 12 of the dish 10 by such as a bolt, and another hole 23 formed therein. A lever 24 has one end coupled to each of the ears 21 by such as a bolt extended through the respective hole 23, and has the other end coupled to the middle portion of a respective rib 12 so that the dish 10 can be stably fixed on the base 20. The base 20 includes an extension 25 extended therefrom. A bolt 26 has one end pivotally coupled to the extension 25. The base 20 further includes two lugs 27 each having a curved slot 28 formed therein. A hole 29 is formed in the center of curvature of each of the curved slots 28.

The guide 30 includes two spaced members 31 extended upward therefrom and two spaced elements 35 extended downward therefrom. Two orifices 32, 33 are formed in each of the members 31. A bolt 320 extends through each of the orifices 32 and a respective hole 29 so that the guide 30 is rotatable relative to the base 20 about the bolts 320. A bolt 330 is engaged in each of the orifices 33 and is engaged in the respective slots 28 of the lugs 27 so that the lugs 27 can be fixed to the members 31. The angular position of the base 20 relative to the guide 30 about the bolts 320 can be adjusted by the engagement between the bolts 330 and the slots 28 of the lugs 27. A projection 34 extends outward from the guide 30. The bolt 26 has the other end engaged to the projection 34 by two nuts 260 and arranged such that the angular position of the base 20 relative to the guide 30 can further be adjusted by the bolt 26 and nuts 260. Each of the elements 35 includes a curved groove 36 and a hole 37 formed in the center of curvature of the curved groove 36. A drag 38 extends outward from the guide 30.

The coupler 40 is fixed to the post 50 and includes two spaced flanges 41 extended upward therefrom each including an aperture 42 pivotally coupled to the holes 37 of the elements 35 by bolts 420 so that the guide 30 is rotatable relative to the coupler 40 about the bolts 420, and another aperture 43 slidably engaged to the curved grooves 36 of the elements 35 by bolts 430 and can be fixed in place by the bolts 430. The axis of the bolts 320 and the axis of the bolts 420 are preferably perpendicular with each other. It is to be noted that the base 20 is rotatable relative to the guide 30 about the bolts 320, and the guide 30 is rotatable relative to the coupler 40 about the bolts 420 so that the angular position of the dish 10 relative to the coupler 40 can be freely and easily adjusted. A strip 44 extends outward from the coupler 40. A support 45 has one end fixed to the coupler 40 and has a cylinder 46 fixed to the other end thereof. The piston rod 47 of the cylinder 46 is pivotally coupled to the drag 38 of the guide 30 so that the guide 30 can be caused to rotate about the bolts 420 by the cylinder 46.

Two engaging devices each including two parts 52, 54 are fixed on the lower end of the post 50 and are fixed to the ground 56 and the like by four brackets 58 so that the dish antenna can be fixed on the ground 56 (FIG. 1).

Alternatively, as shown in FIG. 3, the dish 10 is fixed to the base 20 whose lugs 27 are pivotally coupled to the flanges 41 of the coupler 40 by bolts 420 and the bolts 430 are slidably engaged in the curved slots 28 of the lugs 27 so that the base 20 is rotatable relative to the coupler 40 about the bolts 420 and can be fixed in place by the bolts 430. The other end of the bolt 26 is engaged to the strip 44 of the coupler 40 by the nuts 260 and arranged such that the angular position of the base 20 relative to the coupler 40 can further be adjusted by the bolt 26 and nuts 260. The engaging devices 52, 54 are fixed to a wall member 57 so that the dish antenna can be attached to a wall member.

Further, alternatively, as shown in FIG. 4, the dish 10 is fixed to the base 20, which is fixed the guide 30, which is then fixed to the coupler 40. The coupler 40 is fixed to the post 50 which is laterally fixed to a wall member 59 so that the dish antenna can be laterally fixed to the wall member.

Accordingly, the dish antenna in accordance with the present invention can be adjusted to any suitable angular position and can be disposed on either the ground or the wall member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dish antenna comprising a dish including an outer surface, a plurality of ribs formed on said outer surface of said dish, a base fixed to said outer surface of said dish and including a plurality of ears formed thereon for engagement with a lower end of said ribs of said dish respectively and a pair of lugs extended downward therefrom, each of said lugs including a first curved slot formed therein, a lever having one end fixed to each of said ears and having the other end fixed to a middle portion of a respective rib to stably fix said dish to said base, a guide including a pair of members extended upward therefrom and a pair of elements extended downward therefrom, each of said elements having a second curved slot formed therein, said lugs pivotally coupled to said members on a first pivot axis, said first pivot axis being located at a center of curvature of each of said first curved slots, a first bolt slidably engaged in each of said first curved slots and engaged on each of said members for fixing said lugs to said members to adjust an angular position of said base relative to said guide; a coupler including a pair of flanges extended upward therefrom and pivotally coupled to said elements of said guide at a second pivot axis, said second pivot axis being located at a center of curvature of said second curved slots, a second bolt slidably engaged in each of said second curved slots of said elements and engaged on said flanges for fixing said elements to said flanges to adjust an angular position of said guide relative to said coupler, said first pivot axis and said second pivot axis being perpendicular with each other; a drag extended from said guide, a support fixed to said coupler, a cylinder fixed to said support and including a piston rod coupled to said drag and arranged such that said guide is rotated about said second pivot axis by said cylinder.

* * * * *